US005368237A

United States Patent [19]

Fulkerson

[11] Patent Number: 5,368,237

[45] Date of Patent: Nov. 29, 1994

[54] POWER COATING GUNS WITH IMPROVED SPRAY NOZZLES AND IMPROVED METHOD OF POWER COATING

[75] Inventor: Terrence M. Fulkerson, Parma, Ohio

[73] Assignee: Nordson Corporation, Westlake, Ohio

[21] Appl. No.: 964,547

[22] Filed: Nov. 23, 1992

[51] Int. Cl.[5] ..... B05B 5/025

[52] U.S. Cl. ..... 239/706; 239/708; 239/526; 239/601; 239/DIG. 14

[58] Field of Search ..... 239/690, 696, 706, 708, 239/526, 601, DIG. 14; 118/620, 621, 624, 626, 640

[56] References Cited

U.S. PATENT DOCUMENTS

| | | | |
|---|---|---|---|
| 1,681,230 | 8/1928 | Gooseide | 239/601 X |
| 1,968,348 | 7/1934 | Placide | 239/601 X |
| 3,039,696 | 6/1962 | Point et al. | 239/706 X |
| 3,606,169 | 9/1971 | West | 239/597 |
| 3,659,151 | 4/1972 | Fabre | 239/3 X |
| 3,659,787 | 5/1972 | Ito | 239/708 |
| 4,141,503 | 2/1979 | Beck | 239/394 |
| 4,380,320 | 4/1983 | Hollstein et al. | 239/697 |
| 4,638,951 | 1/1987 | Gabriel | 239/707 |
| 4,811,898 | 3/1989 | Murphy | 239/3 |
| 4,830,279 | 5/1989 | Crum et al. | 239/3 |
| 5,056,720 | 10/1991 | Crum et al. | 239/698 |

FOREIGN PATENT DOCUMENTS

| | | | |
|---|---|---|---|
| 0237207 | 2/1987 | European Pat. Off. . | |
| 0365225 | 4/1988 | European Pat. Off. . | |
| 278209 | 8/1988 | European Pat. Off. | 239/601 |
| 2605533 | 4/1990 | France . | |
| 2755993 | 6/1978 | Germany | 239/601 |
| 58-143163 | 8/1983 | Japan | 239/601 |

*Primary Examiner*—Andres Kashnikow
*Assistant Examiner*—Lesley D. Morris
*Attorney, Agent, or Firm*—Howard M. Cohn

[57] ABSTRACT

A spray gun with a powder spray nozzle sprays a pattern of coating material through specified discharge slot configurations to evenly coat a recess and/or the surface of a substrate. One discharge slot configuration, having two intersecting slots disposed at substantially sixty degree angles to each other, can be rotated to change the width of the coating being applied within the recess. The other slot configuration, having at least five radial slots and a substantially circular bore extending through the intersection of the slots, is effective to coat both the recess and the flat surface of the substrate.

19 Claims, 9 Drawing Sheets

POWER COATING GUNS WITH IMPROVED SPRAY NOZZLES AND IMPROVED METHOD OF POWER COATING

FIELD OF THE INVENTION

This invention relates to powder spray equipment, and more particularly to powder spray guns incorporating improved spray nozzles and the method of using the spray nozzles for applying solid, particulate, powder material to coat a recess and/or a flat surface of a substrate.

BACKGROUND OF THE INVENTION

In the application of solid particulate material, such as powdered paints in industrial finishing applications, the powder material is commonly conveyed to a spray gun by pressure and then dispensed from a spray nozzle attached to the gun as a powder entrained, air stream towards an object or target substrate to be coated or painted. The particles of powder being dispensed from the gun are imparted with an electrical charge to electrostatically attract them towards the substrate held at electrical ground potential. After coating, the target substrate is usually conveyed into an oven for heating and melting the powder coating material on the substrate.

A powder spray gun is generally constructed from a barrel, formed with a powder flow passage, having a spray nozzle mounted at the forward end thereof. The spray nozzle can be formed with a generally circular-shaped discharge opening, as disclosed in U.S. Pat. Nos. 3,659,151, 4,380,320, 4,811,898 and 5,056,720, through which powder coating particles are emitted to form a generally conical shaped spray pattern upon the substance to be coated. Alternatively, the spray nozzle can be formed with a generally elongated, rectangular-shaped slot, of the type disclosed in U.S. Pat. Nos. 3,659,787, 4,638,951 and 4,830,279 as well as European Patent Publication No. 0237207, through which the powder coating particles are discharged to form a so-called "flat" spray pattern which diverges outwardly in a generally triangular shape. Another spray nozzle could be formed with cross cut slots disposed at ninety degrees to each other, as illustrated in FIGS. 3–5, herein.

In order to maximize coverage of a target substrate with coating particles, a strong electrostatic field can be created between an electrode and the target substrate so the coating particles are adequately charged and then strongly attracted to the target substrate. Typically, an electrode is mounted at the forward end of the spray gun, in the vicinity of the discharge opening of the spray nozzle, to impart the electrostatic charge to the powder coating particles emitted from the spray nozzle.

While the prior art nozzle designs have been generally adequate for spraying substrates or products with primarily flat, planar surfaces, they have been less effective for spraying an even coating of powder on substrates, such as the product 8 illustrated in FIG. 1 having a recess or corner configuration like triangularly shaped groove 10 with side walls 12 and 14 which converge and intersect at an innermost edge 16. Moreover, prior art nozzles have been generally ineffective for spraying both a flat surface as well as a recess or corner configuration with an even coating of powder. This deficiency is particularly accentuated in a production line where an operator needs the flexibility of spraying the moving surfaces of advancing substrates have various configurations without the need of changing spray guns or nozzles.

When spraying with nozzles described in certain patents listed before, the problem of forming an uneven coating problem is sometimes caused by the Faraday cage effect. This is an electrostatic phenomena where charged coating particles looking for ground, i.e., the object being sprayed, are more attracted to and therefore stick to the outer sections 18 and 20 of side walls 12 and 14, as illustrated in FIG. 2, respectively, prior to coating the innermost section 22 adjacent the innermost edge 16. The result is an uneven coating with the innermost section 22 having a lighter coating of powder than the more outwardly positioned sections 18,20 of the sidewalls.

To overcome this deficiency, various types of prior art nozzles have been used to spray a recess in a target substrate. For example, a small, tubular shaped spray pattern formed with a pattern adjustment sleeve incorporated in the spray gun described in the previously listed U.S. Pat. No. 4,811,898 patent, can be moved forward relative to a small deflector to turn the flow in a more forward direction. This setup narrows the width of the spray pattern of coating particles applied to the object being coated. While the coating material can then penetrate deep enough into the recess, the spray pattern has a doughnut shape with the powder coating in the center being lighter than the outer part of the pattern. Therefore, the powder still has a tendency to stick to the sidewalls without penetrating enough to evenly cover the sidewalls of the innermost section of the recess.

Alternatively, the deflector of the gun described in the U.S. Pat. No. 4,811,898 patent can be positioned so that a "pin point" spray pattern reaches the innermost portion of the recess. However, with this nozzle configuration, the powder does not adequately coat the outer sections of the recess sidewalls. Since the parts or substrates being sprayed are typically moving down a paint line at a relatively rapid rate of about ten to thirty feet a minute, the operator does not have adequate time to properly spray both the innermost and outer sections of the sidewalls forming the recess.

Spray nozzles with ninety degree, cross cut slots overcome this problem and the powder can evenly coat a small section of the sidewalls in the recess, as illustrated in FIG. 2A. However, the powder still does not adequately coat the sidewalls of a deep recess. Further, this type of nozzle is not suitable for applying a large, even spray pattern on the adjacent flat surfaces of the substrate.

With the flat spray pattern produced by nozzles described in certain other patents listed before, the coating powder is pressurized and emitted from the nozzle at a high velocity so that the discharged particles cover a wide spray pattern. While effective for coating a flat surface, the high pressure causes the powder to rebound out of a recess. Under these circumstances, the flow direction of the spray pattern is not adequately controlled and the resulting spray coating is uneven within the recess. To compensate for the uneven coating, excess powder can be sprayed to cover the sides of the recess. However, this is detrimental because of the increase in powder usage and the resulting added manufacturing costs. Another problem relating to increasing the pressure and/or velocity of the powder emitted from the nozzle is an increase in the wear on the spray gun parts and the additional expense in replacement parts and operator time to maintain the spraying equipment.

Another problem caused by increasing the velocity of charged powder flow is the shortened time in which the powder resides in the strongest part of the electrostatic field which is nearest to the electrode which results in a decrease in electrostatic charge applied to the particles. The result is that the powder penetrates deeper into the recess without adequately sticking to the side walls.

OBJECTS AND SUMMARY OF THE INVENTION

It is an object of the present invention to provide a powder spray gun nozzle and method of operating the nozzle which facilitates the spraying of a substrate having a recess which obviates the problems and limitations of the prior art systems.

It is another object of the present invention to provide a powder gun spray nozzle and method of operating the nozzle which produces a spray pattern of powder that can evenly coat both the recess and flat surface of a substrate.

It is still another object of the present invention to provide a powder gun spray nozzle and method of operating the nozzle which can be rotated about a longitudinal axis through the nozzle for controlling the amount of coated surface area on the side wall surfaces forming the recess of a substrate.

In accordance with the invention, a powder spray nozzle adapted for a spray gun to spray a pattern of powder coating material, comprises a nozzle body having an axial throughbore extending between an enclosed forward end and a rearward end adapted to receive the powder coating material. Discharge slot means extends through the enclosed forward end of the nozzle body and communicates with the throughbore for spraying a pattern of the powder coating material. The discharge slot means comprises at least five radial openings disposed at substantially equal angles to each other and a substantially circular bore disposed coaxially with a longitudinal axis extending through the nozzle body.

Further, in accordance with the invention, the discharge slot means comprises three intersecting slots forming six radial openings disposed at substantially equal angles to each other and a circular bore which extends through the nozzle body at the intersection of the three intersecting slots. Preferably, the three intersecting slots and the circular bore are disposed at substantially right angles to the longitudinal axis through the spray nozzle body. At the forward end of the throughbore is a truncated spherical section. The axial throughbore also includes a rearward section with a circular cross section and a truncated conical section connecting the rearward section to the truncated spherical section.

Also, in accordance with the invention, a powder spray nozzle adapted for use with a spray gun to spray a pattern of powder coating material comprises a nozzle body having an axial throughbore extending between an enclosed forward end and a rearward end. The throughbore is adapted to receive the powder coating material in the rearward end. Discharge slot means extends through the enclosed forward end of the nozzle body for spraying a pattern of the powder coating material onto walls of a recess formed in a substrate whereby the pattern of powder coating material is relatively evenly applied on the walls. The slot means is positioned with respect to the recess and rotated about the longitudinal axis extending through the nozzle body to control the width of the coating pattern on the walls.

In accordance with another embodiment of the invention, the discharge slot means comprises two intersecting slots disposed at an angle of about fifty five to about sixty degrees to each other. The two intersecting slots are disposed at substantially right angles to the longitudinal axis through the nozzle body. The forward end of the throughbore is a truncated spherical section. Preferably, the axial throughbore includes a rearward section with a circular cross section and a truncated conical section connecting the rearward section to the truncated spherical section.

Also, in accordance with the latter embodiment of the invention, the sidewalls of the intersecting slots extend completely through the truncated spherical section and partially into the truncated conical section in the longitudinal direction from the enclosed forward end towards the rearward end. The intersecting slots are each constructed with parallel, opposing side walls.

Further in accordance with the invention is a method of spraying a pattern of powder coating material onto a substrate having a surface and a recess therein. The method comprises the following steps. Pressurized powder coating material is directed into a powder spray nozzle mounted on a spray gun. A substantially conical pattern of the pressurized powder coating material is discharged from a discharge slot of the spray nozzle. The discharge slot is positioned at a first location near the recess to evenly coat side walls of the recess with the coating material. The discharge slot is then moved back from the first position away from the substrate to evenly coat the surface of the substrate with the coating material.

Also in accordance with the invention, is the method of spraying a pattern of powder coating material onto a substrate having a surface and a recess therein. The method comprises the following steps. Pressurized powder coating material is directed into a powder spray nozzle mounted on a spray gun. A pattern of the pressurized powder coating material is sprayed from a discharge slot of the spray nozzle into the recess to apply a relatively even coating of powder coating material on walls of the recess. The slot is rotated about a longitudinal axis extending through the nozzle with respect to the recess to vary the width of the coating on the walls.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 6:
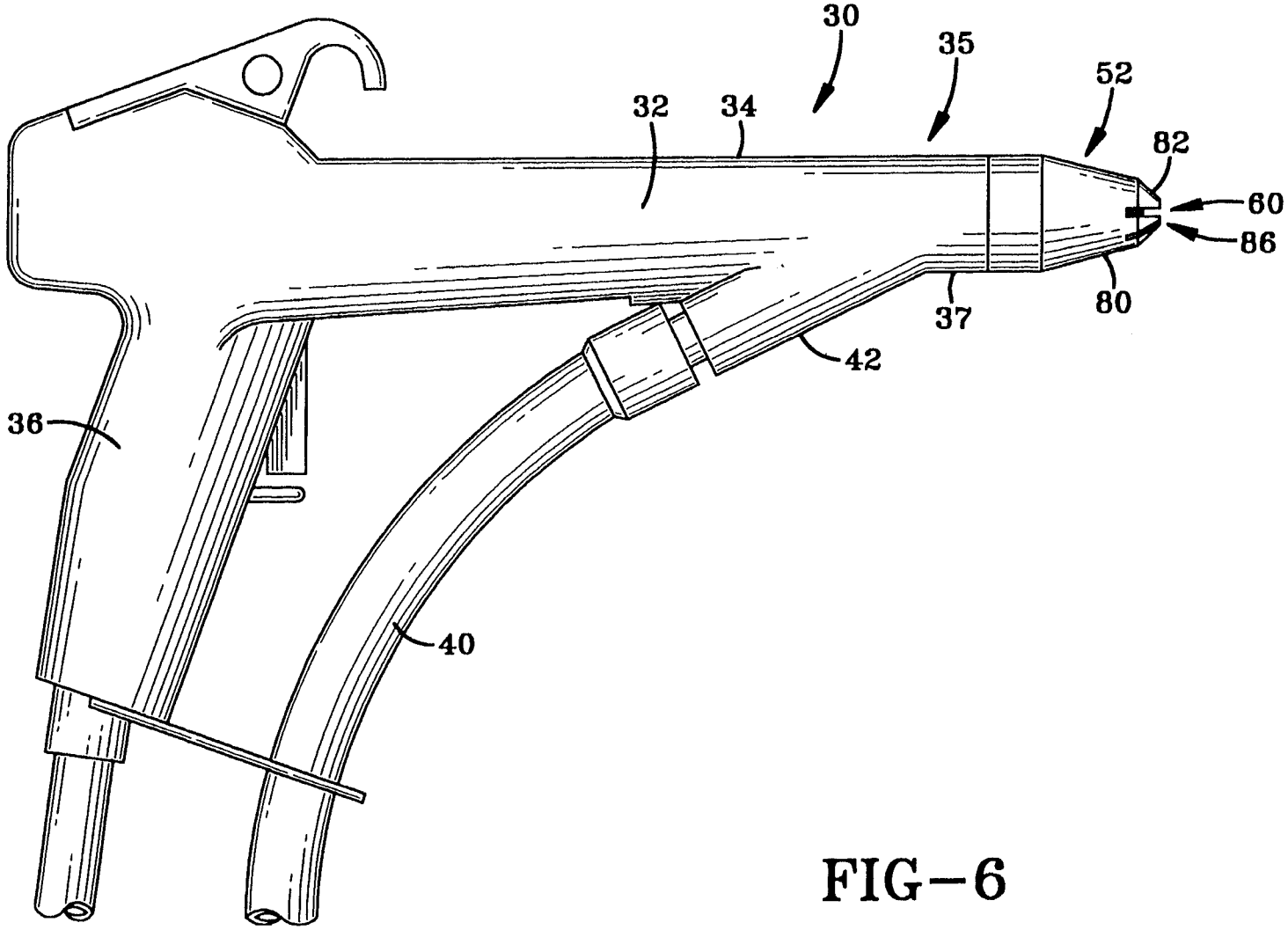
FIG. 6 is a side elevational view of a powder spray gun having a powder spray nozzle incorporating the sixty degree cross cut nozzle of the present invention.
Figure 6A:
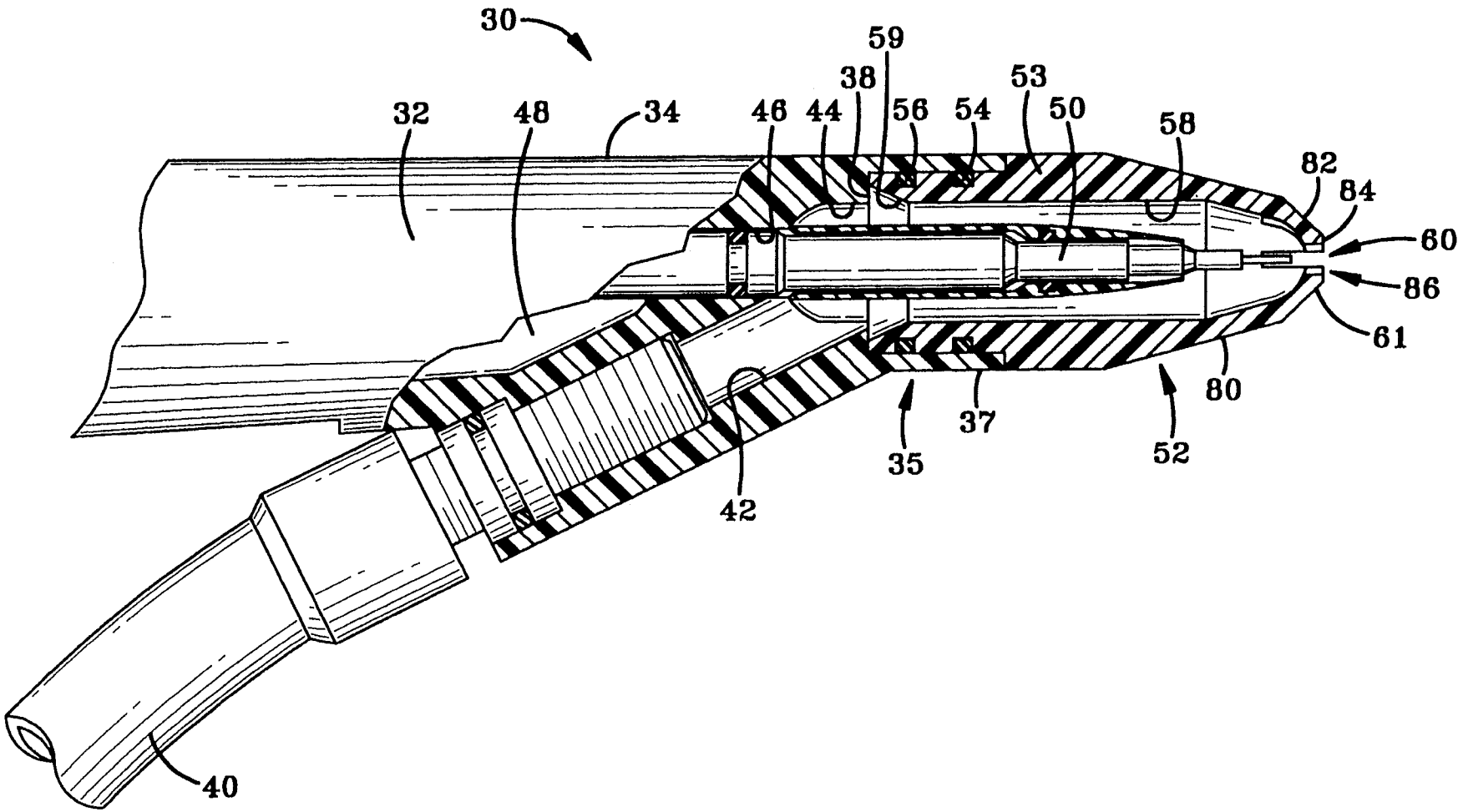
FIG. 6A is a side elevational view, partly in cross section, of a powder spray gun illustrated in FIG. 6.

Referring to FIGS. 6 & 6A, a spray gun 30 for spraying powder coating material is illustrated. The spray gun can be of a conventional design, such as the type disclosed and illustrated in U.S. Pat. No. 5,056,720, assigned to the same assignee as this invention. Reference should be made to the disclosure of that patent for a detailed discussion of spray gun 30 which is incorporated by reference in its entirety herein.

For purposes of the present discussion, spray gun 30, as illustrated in FIGS. 6 & 6A, comprises a pistol shaped housing 32 with a tubular section 34 terminating at a discharge end 35 and at a handle 36. Discharge end 35 is formed with forward cylindrical section 37, having a larger inner diameter than the inner diameter of throughbore 44 within tubular section 34, and a shoulder 38 therebetween. A conduit 40 delivers powder coating material, from a source of powder coating material (not shown), to an intake bore 42 that provides external access to throughbore 44 located centrally within tubular section 34. Throughbore 44 communicates via a transverse wall 46 with an internal chamber 48 extending rearward through tubular section 34 towards handle 36. An electrode assembly 50 is mounted to the forward end of an electric multiplier circuit (not shown) and extends from the chamber 48 through the wall 46 and projects outward from discharge end 35 of tubular section 34. The electrode assembly 50 terminates within a nozzle 52 of electrically non-conductive material, described hereinafter, for electrostatically charging coating powder prior to discharge from the nozzle.

Figure 1:
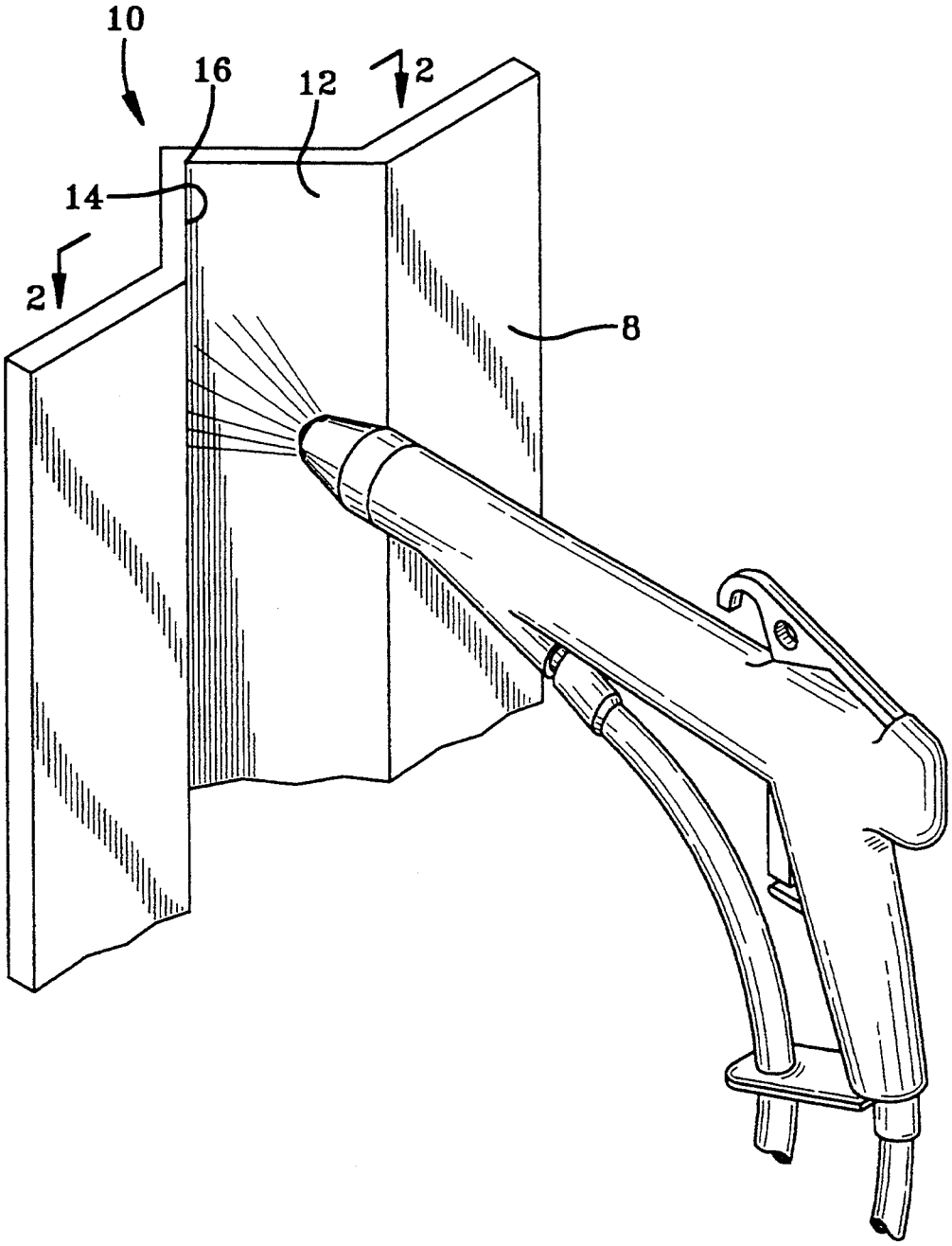
FIG. 1 is a perspective view of a spray gun having a powder spray nozzle pointed at a recess in a flat target substrate.
Figure 2:
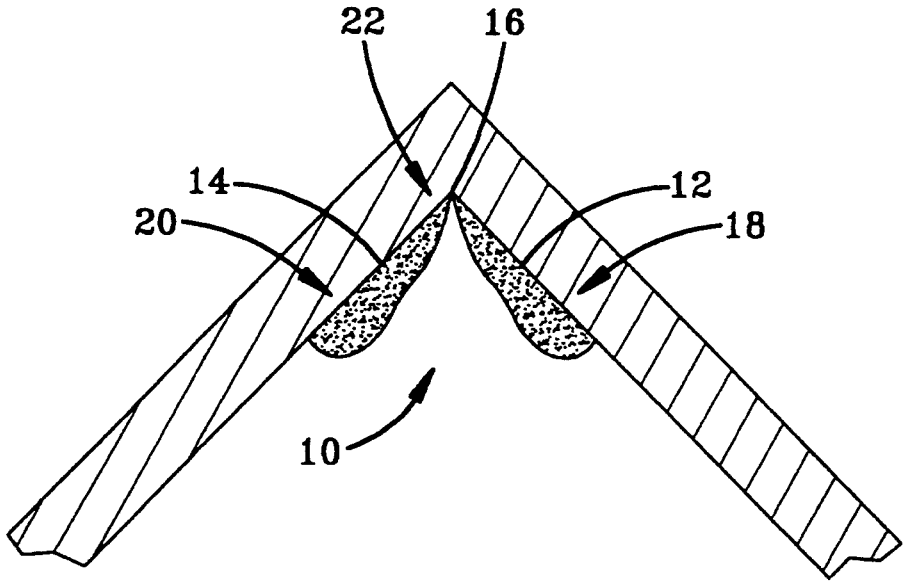
FIG-2 PRIOR ART
FIG. 2 is an enlarged view, in cross section, taken along lines 2—2 of FIG. 1, subsequent to spray coating with a powder spray nozzle constructed in accordance with typical prior art nozzles.
Figure 2A:
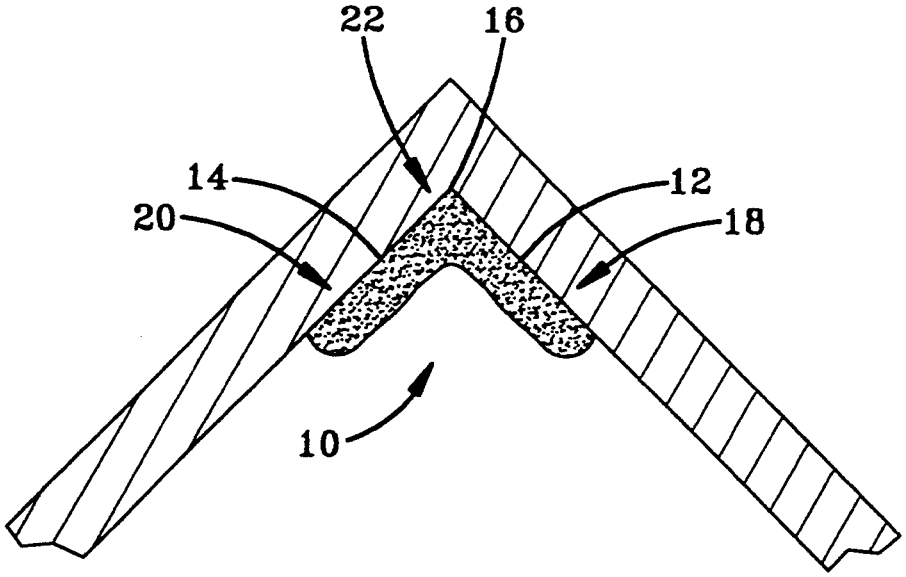
FIG-2A PRIOR ART
FIG. 2A is an enlarged view, in cross section, taken along lines 2—2 of FIG. 1, subsequent to spray coating with a powder spray nozzle constructed in accordance with a prior art cross cut nozzle with the slots disposed at about ninety degrees to each other.
Figure 2B:
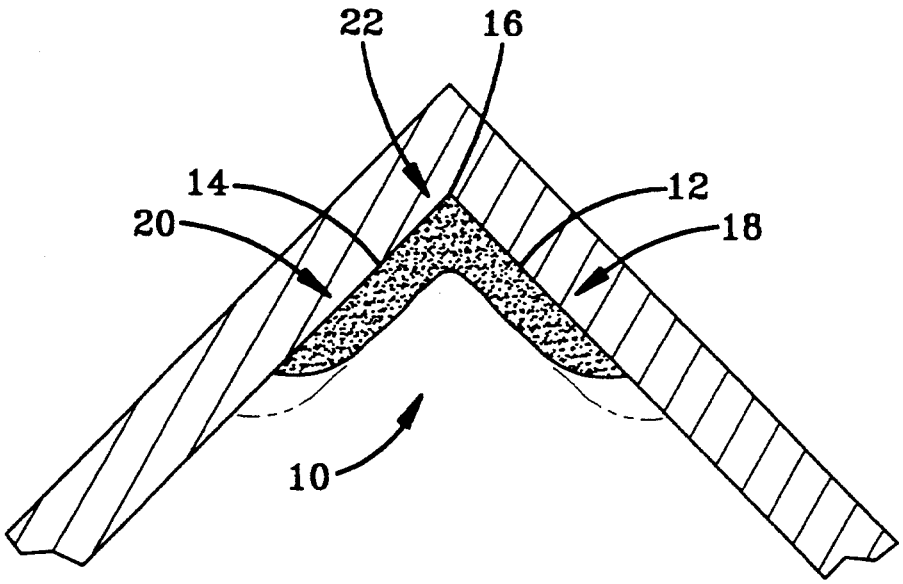
FIG. 2B is an enlarged view, in cross section, taken along lines 2—2 of FIG. 1, subsequent to spray coating with a powder spray nozzle constructed in accordance with a cross cut nozzle with two slots disposed at sixty degrees to each other in accordance with the invention.
Figure 2C:
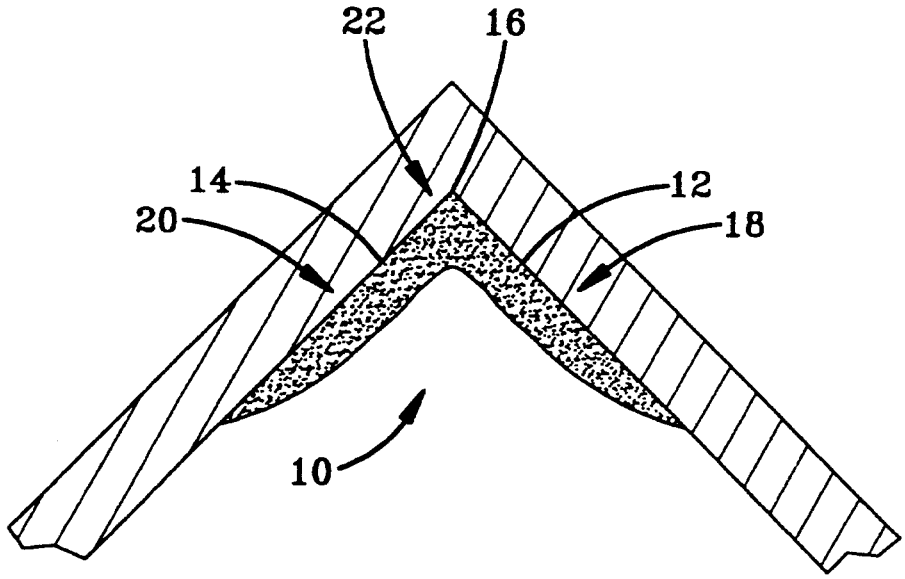
FIG. 2C is an enlarged view, in cross section, taken along lines 2—2 of FIG. 1, subsequent to spray coating with a powder spray nozzle constructed in accordance with a castle nozzle of the present invention.
Figure 3:
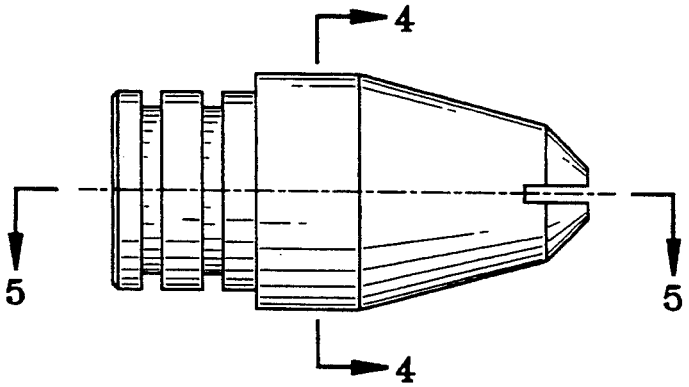
FIG-3 PRIOR ART
FIG. 3 is a side elevational view of a ninety degree, cross-cut powder spray nozzle in accordance with the prior art.
Figure 4:
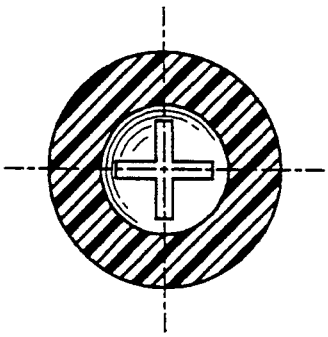
FIG-4 PRIOR ART
FIG. 4 is a view taken along lines 4—4 of FIG. 3.
Figure 5:
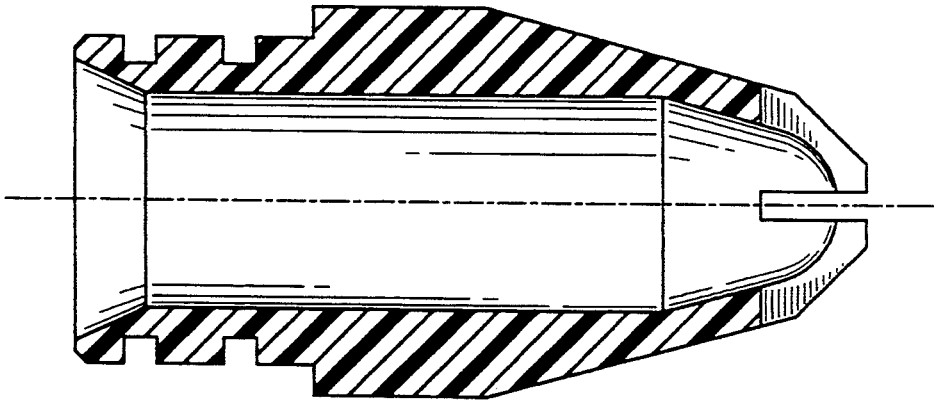
FIG-5 PRIOR ART
FIG. 5 is a view taken along lines 5—5 of FIG. 3.

Nozzle 52 is adapted to be securely mounted to the discharge end 35 of tubular section 34. Spray nozzle 52 is a unitary, one piece nozzle body 53 formed with an axial throughbore 58 having an inlet opening 59 at one end and a discharge opening 60 at the forward discharge end 61 thereof. An important aspect of this invention relates to the shape of the nozzle and its discharge opening which are configured to produce a spray pattern capable of coating a recess in a target substrate with a substantially even coating of powder, as illustrated in FIGS. 2B and 2C.

Referring now to FIGS. 6, 6A, 7, 8, 9 and 14, a sixty degree, cross-cut, spray nozzle 52 is illustrated. Spray nozzle body 53 is formed with an axial throughbore 58 including an enlarged diameter, rearward section 62, a truncated spherical section 64 and a truncated conical section 66 therebetween. In a test embodiment, the truncated spherical section has approximately a ½ inch diameter. The truncated conical section 66 converges at an angle "a" of between about twenty and forty degrees and preferably about thirty degrees about centerline 68 extending longitudinally through nozzle body 53. The external surface of nozzle body 53 is formed with a central portion 70 having an enlarged diameter, a rearward portion 72 having a smaller diameter as compared with the diameter of central portion 70 and an annular shoulder 74 therebetween. Two spaced grooves 76 and 78 are provided on rearward portion 72 to receive 0-rings 54 and 56, respectively. A forward portion 80 tapers radially inward from the central portion 70 and intersects an end portion 82. The end portion 82 tapers radially inward from the forward portion 80 and intersects a forward, generally circular, flat end 84 of the nozzle body.

Figure 7:
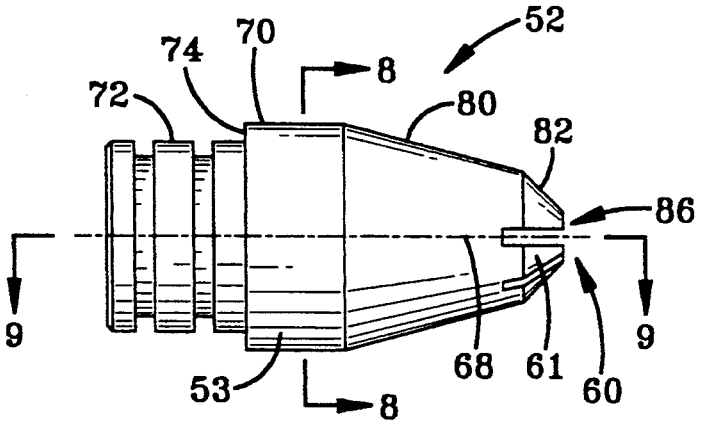
FIG. 7 is a side elevational view of a sixty degree, cross-cut powder spray nozzle in accordance with the present invention.
Figure 9:
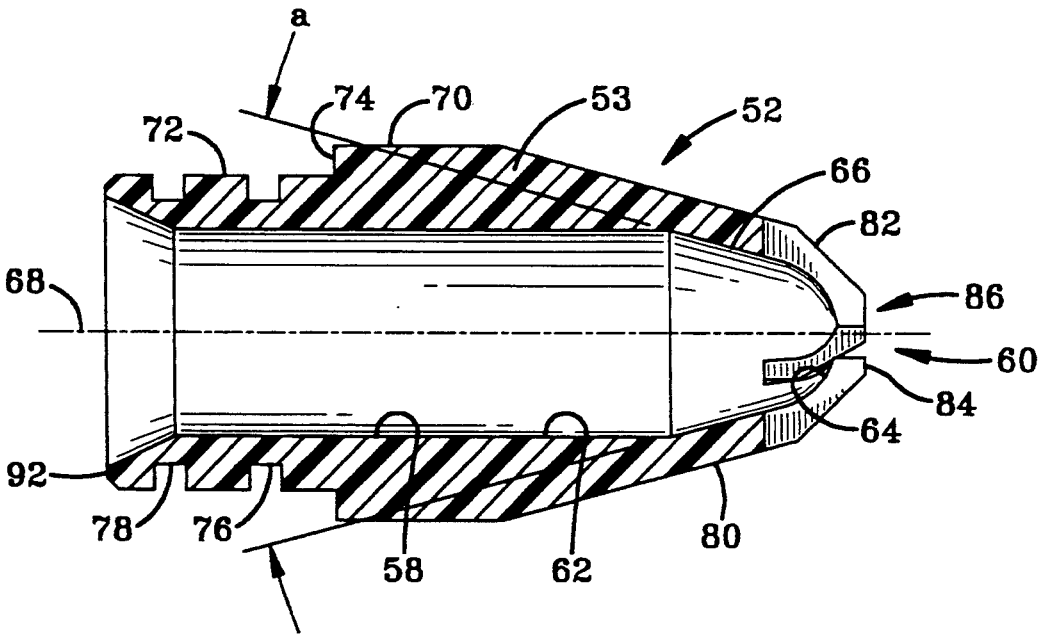
FIG. 9 is a top view taken along lines 9—9 of FIG. 7.

The discharge opening 60 at the forward end of spray nozzle body 53 comprises discharge slot means 86 adapted to obtain the desired flat, elliptical spray pattern to evenly coat a recess in a target substrate. The discharge slot means 86 can comprise discharge slots 88 and 90 disposed at an angle "b" of approximately fifty five to sixty five degrees to each other and more preferably at an angle of about sixty degrees to each other and at a right angle to the longitudinal axis 68 therethrough. The discharge slots 88 and 90 form four radial openings having substantially parallel side walls extending through the end portion 82 and partially into the forward portion 80, as illustrated in FIGS. 7 and 9. In a test embodiment, the discharge slots have a width of about 0.093 inches.

To secure nozzle body 53 to the tubular section 34, the rearward portion 72 of nozzle 52 can be slidably inserted into the forward, cylindrical section 37 of discharge end 35 and retained therein by frictional engagement with 0-rings 54,56. As illustrated in FIG. 6A, the spray nozzle 52 is positioned so that the rearward edge 92 thereof contacts shoulder 38 of tubular section 34 and annular shoulder 74 abuts against the forward end of section 37.

In operation, spray gun 30 is typically operated at about 5–7 pounds per square inch and with a powder flow of about twenty pounds per hour. The electrode 50 disposed in nozzle 52 creates an electric field which emanates from the nozzle. The coating powder delivered from hose 40 into axial throughbore 58 generally follows the electrostatic field. Before a part or target substrate to be spray painted arrives in front of spray gun 30, the powder pattern moves in a random fashion with the powder looking for an electrically grounded place to which it can adhere. The majority of the powder flow is, at this stage, discharged longitudinally outward from discharge opening 60 of nozzle 52. As the spray gun is moved closer to the target substrate being painted, the size of the electrostatic field is reduced and the powder pattern is pulled with it causing the diameter of the powder cloud to shrink down and form a cone like spray pattern. That is, the pattern has a curved cross section having a resemblance of a shape between a circle and an ellipse. In effect, the electrostatic field adjusts the shape of the powder cloud for improved penetration, into the recess formed on the target substrate. However, as the discharge end 61 of the spray gun moves closer to the target substrate, the electrostatically charged powder doesn't see the entire target substrate to be sprayed but seeks that portion of the target substrate which is closest to discharge end 61 of the spray gun. As discussed in the background of the invention, the prior art nozzles did not effective coat both the side walls and the innermost portion of the recess. Typically, a spray coating preferably has a thickness between about 0.001 inch and about 0.003 inch. For the purpose of this invention, an even coating has a thickness which preferably does not vary more than about 0.0005 inch.

Figure 8:
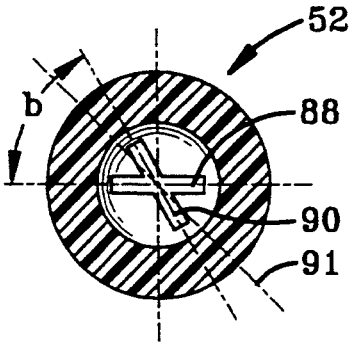
FIG. 8 is a rear view taken along lines 8—8 of FIG. 7.
Figure 14:
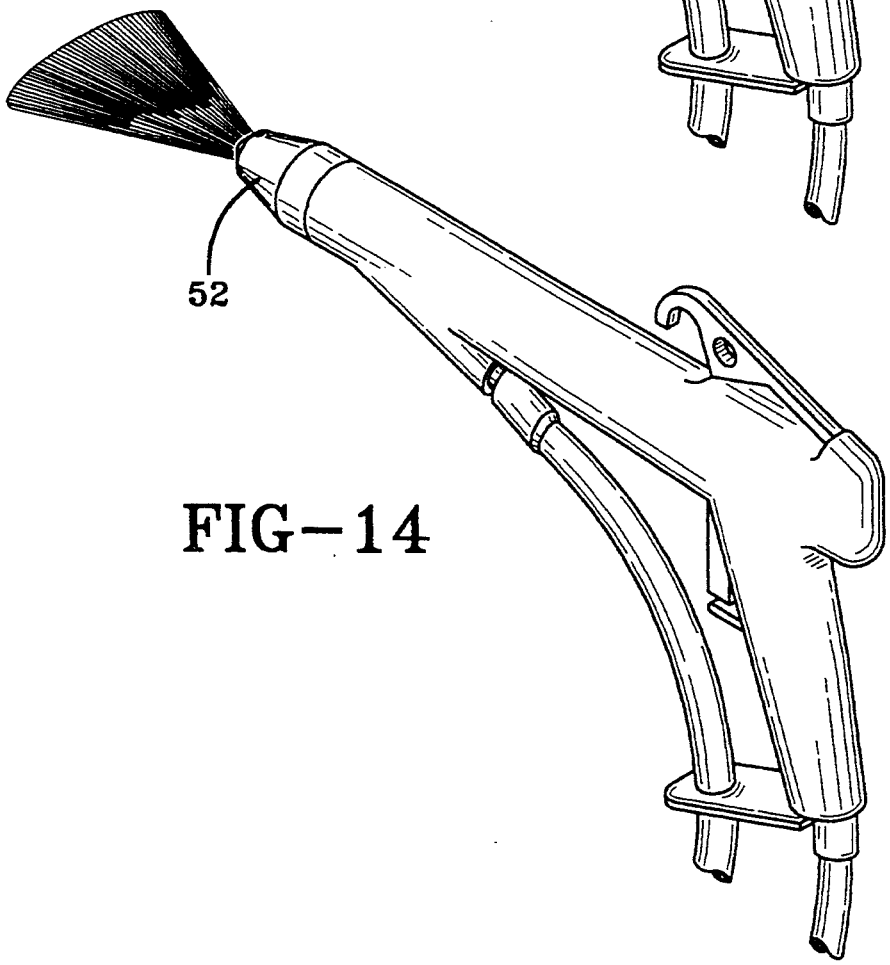
FIG. 14 is a perspective view illustrating the elliptical spray pattern of a spray gun having a sixty degree cross-cut powder spray nozzle.

The sixty degree, cross cut nozzle 52, described above, has been found to substantially overcome the problem of inadequate coating within a recess. As the discharge end 61 of the nozzle 52 is moved closer to a recess on a target, such as recess 10 in FIG. 2B, the powder being discharged through nozzle 52 is sprayed radially outward from the intersecting discharge slots 88,90, in a transverse direction to the centerline 68, while simultaneously moving longitudinally forward towards the innermost portion 22 of the recess. The discharge slots 88,90 produce a flat spray pattern, as illustrated in FIG. 14 having an elliptical cross section which is longer than wide. The powder adhering to the walls 12,14 and innermost portion 22 of the recess blend into a coating of relatively even thickness. While the powder is naturally attracted to the sidewalls 12,14 which are closer to the nozzle then the innermost portion 22 of the recess, the velocity of the powder causes the powder to spray outward from the discharge slot means 86 and be physically driven into the innermost recess. With the sixty degree, cross cut nozzle 52, the powder penetration and coating on the innermost portion 22 is adequate and distance which the powder coating extends along sidewalls 12 and 14 towards the outer sections 18 and 20 can be controlled by twisting the nozzle about centerline 68. For example, the nozzle 52 can be twisted or turned so that axis 68 remains substantially perpendicular to the intersecting edge 16 of the recess walls 12 and 14*a*, while line 91 (intersecting the oppositely disposed, V-shaped radial openings as illustrated in FIG. 8) is aligned between a parallel and a normal position with respect to the intersecting edge 16 of the recess walls 12 and 14. Referring to FIG. 2B, the solid line represents the parallel position and the dotted line represents the normal position. Thus, the operator can easily control the amount of recess wall surface receiving a relatively even coating of powder by simply rotating the gun about its longitudinally extending axial axis and causing the flat spray pattern to rotate and vary the width of the coating on the surface of the walls of the recess.

While the above described embodiments of the invention provide a very effective means of coating a recess of a target substrate with a coating of powder, it is also within the terms of the invention to provide an alternative embodiment wherein nozzle 52 is replaced with a castle shaped nozzle 110, as illustrated in FIGS. 10, 11, 12 and 13. While castle shaped nozzle 110 is illustrated with six radial openings formed by intersecting discharge slots 112, 114 and 116 formed in the discharge end of nozzle 110, it is within the terms of the invention to form the castle shaped nozzle with five or more radial openings aligned on radial extending centerlines which project at substantially equal angles to each other. Substantially equal angles being in a range of plus or minus five degrees.

Figure 10:
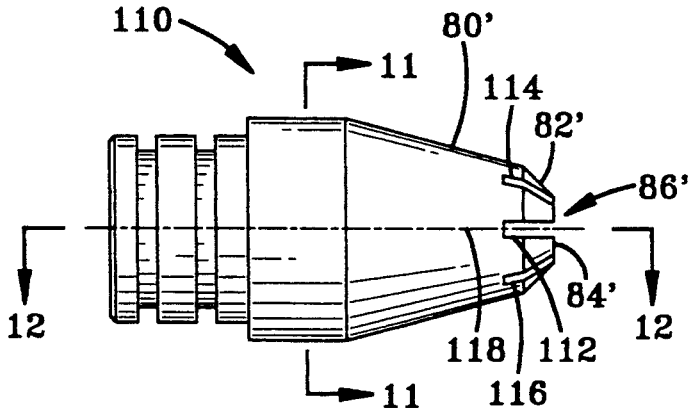
FIG. 10 is a side elevational view of a castle shaped powder spray nozzle in accordance with the present invention.
Figure 11:
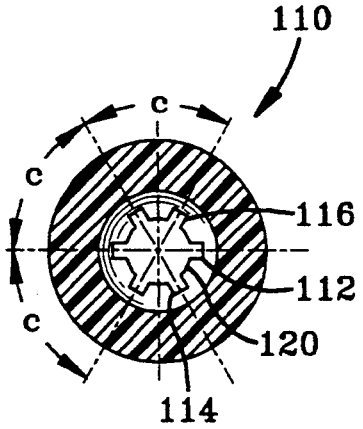
FIG. 11 is an end view taken along lines 11—11 of FIG. 10.
Figure 12:
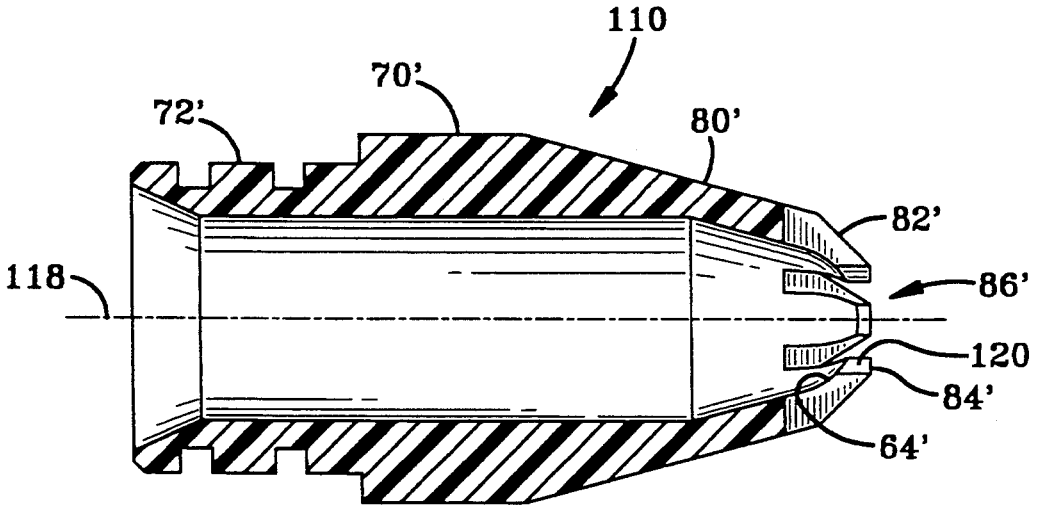
FIG. 12 is a top view taken along lines 12—12 of FIG. 10.

In the preferred embodiment, the discharge slots 112, 114 and 116 are disposed at an angle "c" of approximately sixty degrees to each other and at a substantially right angle to the longitudinal axis 118 through nozzle 110. The opposing side walls of each discharge slot 112, 114 and 116 are substantially parallel to each other and extend through the end portion 82' and partially into the forward portion 80', as illustrated in FIGS. 10 and 12. Throughout the specification, primed numbers represent structural elements which are substantially identical to structural elements represented by the same unprimed number. Besides the angular relationship of the discharge slots 112, 114 and 116 to each other, nozzle 110 is distinguished from the prior described embodiment by the addition of a substantially circular bore 120 which extends through the outer face 84' and is centered on axis 118. In one embodiment, the diameter of bore 120 is between about 11/32 of an inch and about 13/32 of an inch. In practice, a bore having a diameter of about $\frac{3}{8}$ of an inch has proven to be very effective.

Figure 13:
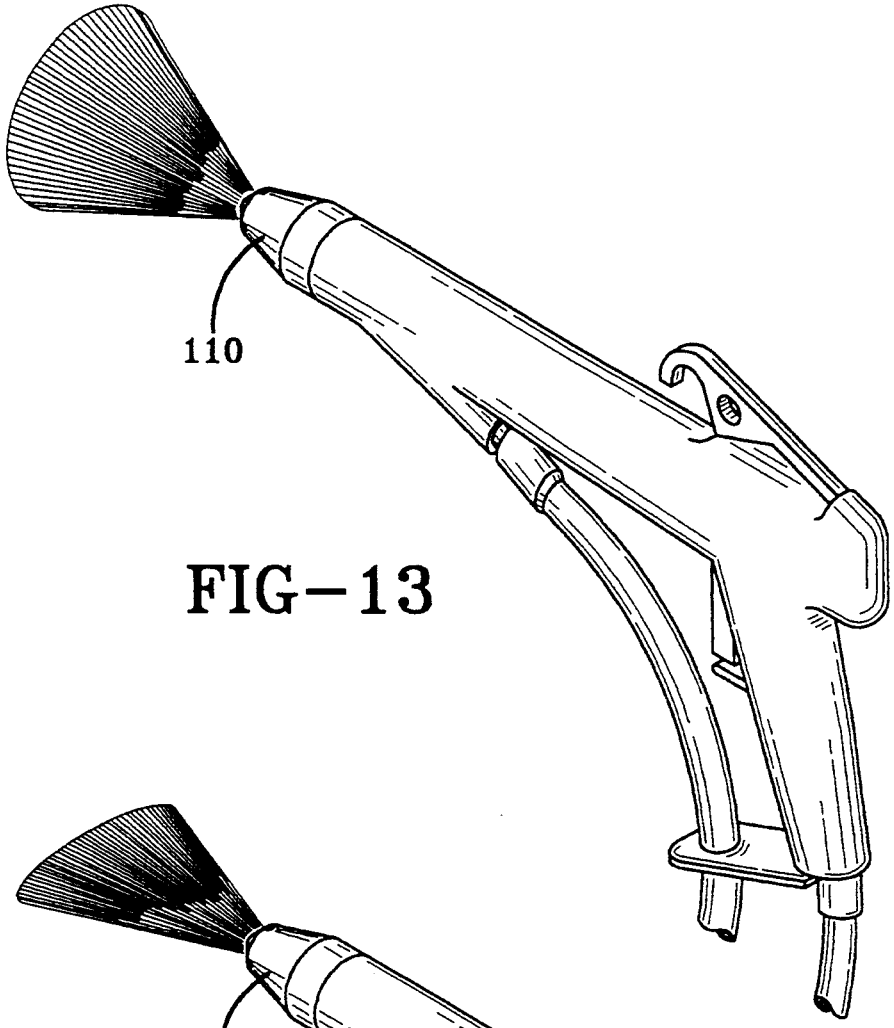
FIG. 13 is a perspective view illustrating the conical spray pattern of a spray gun having a castle powder spray nozzle.

Castle shaped nozzle 110, described above, has been found to be very effective in overcoming the problem of uneven powder coating in a recess. As with the discharge of powder from the nozzle 52, the powder being discharged through nozzle 110 (typically distanced from the surfaces being coated less than about 4 inches to 6 inches) is sprayed radially outward from the intersecting slots 112, 114 and 116, in a transverse direction to the centerline 118, while simultaneously moving towards the innermost portion 22 of the recess, as illustrated in FIG. 2C. The castle nozzle produces a conical spray pattern, as illustrated in FIG. 13, having a generally curved cross section which is nearly circular. That is the spray pattern is approximately conical in shape and is able to form an even coating on a section of side wall extending further from the intersecting edge 16 then the sixty degree nozzle 52 discussed above.

It is thought that the advantage of the castle nozzle is because the plurality of radial openings in combination with the bore 120 causes a higher flow rate and a tighter pattern of powder entrained, air stream than the prior art, conical deflector type nozzles. In addition, the pattern is more directional and more likely to coat the area at which the gun is aimed. Since the higher flow rate directs less cubic feet of air per gram of powder, less air is rebounding out of the recess (such as the inner corners of a box) being spray coated. With less air rebounding out of the space being sprayed, the spray from the nozzle encounters less resistance and is therefore more directional.

Another advantage of the castle nozzle is that the large sized, discharge passage enables more powder to be easily pushed by its velocity into the innermost section of the recess. While more powder penetrates to the innermost section, the air mixed with the powder bleeds off through the plurality of slots. However, the powder, being heavier then the air, has a tendency to settle out from the air and travel through the central bore 120 instead of the slots. Also, since the powder tends to flow out of the central bore, it obstructs the bore and causes the air to take the easiest path from the nozzle, e.g. the slots. The result is a relatively even coating of powder, as illustrated in FIG. 2C.

With increased powder flow through the nozzle, the pressure required to direct the powder flow can be reduced. The effect is less wear on parts and less frequent need for an operator to turn off the system and replace parts.

The castle nozzle, besides being extremely effective for coating tight spots, like recesses, is also useful for coating flat surfaces on substrates by simply distancing the nozzle away from the flat surface so that the conical spray pattern has a larger diameter, i.e., of about 10 inches to about 12 inches. Thus, in operation, the castle nozzle can be easily moved from a position close to a recess being sprayed for evenly coating the surfaces to a position further away where a relatively flat surface can be sprayed. Besides being effective for manual operation, the castle nozzle is an effective all purpose nozzle for use with automated spray systems.

The patents disclosed herein are intended to be incorporated in their entireties by reference hereto.

As can now be appreciated from the above description, there has been provided in accordance with this invention nozzles for use with a powder spray gun which apply an even coating of powder to the side surfaces and innermost portion of a recess being spray coated to satisfy the objects and advantages set forth above. The nozzles of the invention are advantageous because of their interchangability with the nozzles used in the prior art systems. The castle nozzles described above are particularly versatile since they can be used to spray both the flat surface and the recessed surface of a substrate.

While the invention has been described in combination with embodiments thereof, it is evident that many alternatives, modifications, and variations will be apparent to those skilled in the art in light of the foregoing description. Accordingly, it is intended to embrace all such alternatives, modifications and variations as fall within the spirit and scope of the appended claims.

We claim:

1. A powder spray nozzle for spraying powder coating material,.comprising:

a nozzle body of electrically non-conductive material having an axial throughbore extending between an enclosed forward end and a rearward end, said throughbore adapted to receive said powder coating material in said rearward end;

discharge slot means extending through said enclosed forward end of said nozzle body for spraying a relatively even coating of said powder coating material into a recess formed in a substrate, the width of said coating being controlled by rotating said slot means about a longitudinal axis extending through said nozzle body, said discharge slot means being formed by two intersecting slots disposed at an angle of about fifty five to about sixty degrees to each other.

2. The powder spray nozzle as in claim 1 wherein said two intersecting slots are disposed at an angle of about sixty degrees to each other.

3. The powder spray nozzle as in claim 2 wherein said two intersecting slots are disposed at a substantially right angle to said longitudinal axis through said nozzle body.

4. The powder spray nozzle as in claim 3 wherein said forward end of said throughbore is a truncated spherical section.

5. The powder spray nozzle as in claim 4 wherein said axial throughbore includes a rearward section with a circular cross section and a truncated conical section connecting said rearward section to said truncated spherical section.

6. The powder spray nozzle as in claim 5 wherein said sidewalls of said intersecting slots extend completely through said truncated spherical section and partially into said truncated conical section in the longitudinal direction from the enclosed forward end towards the rearward end.

7. The powder spray nozzle as in claim 6 wherein said intersecting slots are each constructed with parallel, opposing sidewalls.

8. A spray gun to spray a pattern of powder coating material towards a substrate, comprising:

a gun housing having a throughbore terminating at a discharge end, a powder intake bore intersecting said throughbore to deliver said powder coating material to said throughbore, and an electrode assembly disposed in said throughbore and extending outward from said discharge end thereof for electrostatically charging said powder coating material;

a powder spray nozzle of electrically non-conductive material mounted to said discharge end of said housing, said powder spray nozzle having a nozzle body with an axial throughbore extending between an enclosed forward end and a rearward end mounted to said discharge end of said housing;

discharge slot means extending through said enclosed forward end of said nozzle body for spraying a relatively even coating of said powder coating material into a recess formed in said substrate whereby the width of said coating is controlled by rotating said slot means about a longitudinal axis extending through said nozzle body, said discharge slot means being formed by two intersecting slots disposed at an angle of about fifty five to about sixty degrees to each other.

9. The spray gun as in claim 8 wherein said two intersecting slots are disposed at a substantially right angle to said longitudinal axis through said nozzle body.

10. The spray gun as in claim 9 wherein said forward end of said throughbore is a truncated spherical section.

11. The spray gun as in claim 10 wherein said axial throughbore includes a rearward section with a circular cross section and a truncated conical section connecting said rearward section to said truncated spherical section.

12. The spray gun as in claim 11 wherein said sidewalls of said intersecting slots extend completely through said truncated spherical section and partially into said truncated conical section in the longitudinal direction from said enclosed forward end towards said rearward end.

13. A powder spray nozzle for spraying powder coating material, comprising:

a nozzle body of electrically non-conductive material having an axial throughbore extending between an enclosed forward end and a rearward end adapted to receive said powder coating material;

discharge slot means extending through said enclosed forward end of said nozzle body and communicating with said throughbore for spraying a pattern of said powder coating material, said discharge slot means being formed by two intersecting slots disposed at an angle of about fifty five to about sixty degrees to each other.

14. The powder spray nozzle as in claim 13 wherein said two intersecting slots are disposed at an angle of about sixty degrees to each other.

15. The powder spray nozzle as in claim 13 wherein said two intersecting slots are disposed at a substantially right angle to said longitudinal axis through said nozzle body.

16. The powder spray nozzle as in claim 15 wherein said forward end of said throughbore is a truncated spherical section.

17. The powder spray nozzle as in claim 16 wherein said axial throughbore includes a rearward section with a circular cross section and a truncated conical section connecting said rearward section to said truncated spherical section.

18. The powder spray nozzle as in claim 17 wherein said sidewalls of said intersecting slots extend completely through said truncated spherical section and partially into said truncated conical section in the longitudinal direction from the enclosed forward end towards the rearward end.

19. The powder spray nozzle as in claim 18 wherein said intersecting slots are each constructed with parallel, opposing sidewalls.

* * * * *

UNITED STATES PATENT AND TRADEMARK OFFICE

CERTIFICATE OF CORRECTION

PATENT NO. : 5,368,237
DATED : November 29, 1994
INVENTOR(S) : Terrence M. Fulkerson It is certified that error appears in the above-indentified patent and that said Letters Patent is hereby corrected as shown below:

On the Title Page, Lines 1 and 3 of the Title and in Column 1, Lines 1 and 3 of the Patent, "Power" should be deleted and replaced with "Powder" in all four (4) instances.

On Column 2, Line 12 of the Patent, insert "to" after "adjacent".

On Column 7, Line 23 of the Patent, delete "effective" and insert --effectively-- in its place.

On Column 9, Line 7 of the Patent, delete "then" and insert --than-- in its place.

On Column 9, Line 55, of the Patent, delete "."

Signed and Sealed this

Thirteenth Day of June, 1995

*Attest:*

*Attesting Officer*

Bruce Lehman

BRUCE LEHMAN

*Commissioner of Patents and Trademarks*